United States Patent [19]

Asano et al.

[11] 4,142,482

[45] Mar. 6, 1979

[54] FEEDBACK EMISSION CONTROL FOR INTERNAL COMBUSTION ENGINES WITH VARIABLE REFERENCE COMPENSATION FOR CHANGE WITH TIME IN PERFORMANCE OF EXHAUST COMPOSITION SENSOR

[75] Inventors: Masaharu Asano, Yokosuka; Takeshi Fujishiro, Yokohama; Shigeo Aono, Seki; Akio Hosaka, Yokohama; Nobuzi Manaka; Mituhiko Ezoe, both of Yokosuka, all of Japan

[73] Assignee: Nissan Motor Company, Limited, Yokohama, Japan

[21] Appl. No.: 767,133

[22] Filed: Feb. 9, 1977

[30] Foreign Application Priority Data

Feb. 9, 1976 [JP] Japan ..... 51-12244

[51] Int. Cl.[2] ..... F02B 3/08; F02M 7/12; F01N 3/08

[52] U.S. Cl. ..... 123/32 EE; 123/119 EC; 60/276; 60/285; 123/32 EK

[58] Field of Search ..... 123/32 EE, 32 EK, 32 EA, 123/119 EC; 60/276, 285

[56] References Cited

U.S. PATENT DOCUMENTS

| | | | |
|---|---|---|---|
| 3,815,561 | 6/1974 | Seitz | 60/276 |
| 3,834,361 | 9/1974 | Keely | 123/32 EA |
| 3,938,479 | 2/1976 | Oberstadt | 123/32 EE |
| 4,015,566 | 4/1977 | Wahl | 60/285 |
| 4,019,474 | 4/1977 | Nishimiya et al. | 123/32 EE |
| 4,030,462 | 6/1977 | Sassayama et al. | 123/32 EE |

FOREIGN PATENT DOCUMENTS

| | | | |
|---|---|---|---|
| 4742407 | 6/1972 | Japan | 123/32 EA |

*Primary Examiner*—Charles J. Myhre
*Assistant Examiner*—P. S. Lall

[57] ABSTRACT

Emission control apparatus for internal combustion engines is provided with a sensor for detecting the concentration of a particular exhaust composition in the emissions from the engine. A signal indicating the deviation of the mixture ratio from a controlled point is generated by comparing the output from the sensor with a reference level, the signal being modified in amplitude according to a predetermined control characteristic and used to regulate the air-fuel mixture ratio at the desired control point. The varying magnitude of the sensed concentration is smoothed into a signal of slowly varying magnitude which is used to control the reference level so that error introduced into the deviation indicating signal due to the change with time in the output performance of the exhaust composition sensor is self-compensated. A level sensor is provided to detect when the reference level reaches an end of the control range to change the operating mode of the engine from closed-loop to open-loop mode.

21 Claims, 4 Drawing Figures

AIR-FUEL MIXING & PROPORTIONING
INTERNAL COMBUSTION ENGINE
CATALYTIC CONVERTER
EXHAUST COMPOSTION SENSOR
EXHAUST
+Vcc
R1
R2
R3
R4
R5
R6
R7
R8
C1
C2
C3
D1
D2
S1
S2
Q1
Q2
S
VL
VU
p
q
10
11
12
13
14
15
16
17
20
21
23
24
25
26
27

FEEDBACK EMISSION CONTROL FOR INTERNAL COMBUSTION ENGINES WITH VARIABLE REFERENCE COMPENSATION FOR CHANGE WITH TIME IN PERFORMANCE OF EXHAUST COMPOSITION SENSOR

FIELD OF THE INVENTION

The present invention relates generally to closed-loop emission control apparatus for internal combustion engines, and in particular to such apparatus wherein the concentration of exhaust composition is detected by a sensor and compared with a reference level which is variable with the magnitude of the detected concentration to compensate for error due to changes in the output performance of the sensor with time.

BACKGROUND OF THE INVENTION

In a closed-loop emission control apparatus for internal combustion engines, the concentration of an exhaust composition is detected by a sensor as a feed-back control signal used to control the air-fuel ratio of the mixture supplied to the engine. The exhaust composition sensor such as zirconium dioxide type oxygen sensor normally generates an output which drops sharply in amplitude at stoichiometry as the detected oxygen concentration increases. More particularly, the output of the sensor is high for rich mixtures and low for lean mixtures. The output from the sensor is compared with a reference level that corresponds to a desired air-fuel ratio in the vicinity of stoichiometry to generate an error compensation signal indicative of the deviation of the mixture from the desired air-fuel ratio. However, the performance of the sensor tends to vary with time such that its sharp transient characteristic is lost and the knee portion of the curve occurs at a lower voltage level than in the earlier stage of use with the result that the reference level no longer coincides with the stoichiometric point of the mixture; specifically, it coincides with a point slightly richer than the desired stoichiometric value, and that for mixtures richer than stoichiometry the sensor delivers a lower voltage than that it is designed to deliver.

SUMMARY OF THE INVENTION

An object of the present invention is therefore to compensate for the error arising from the change with time of the performance of an exhaust composition sensor in order to minimize the amount of noxious emissions over extended period of time.

Another object of the invention is to provide an emission control apparatus in which the sensed concentration of an exhaust composition is compared with a reference level which is variable with the output of the exhaust composition sensor so that error introduced into the difference between the reference level and the sensed concentration is self-compensated as the reference level varies jointly with change in the output performance of the sensor.

A further object of the invention is to provide emission control apparatus in which the sensed concentration of the exhaust composition is used to detect when mixture dwells on one of its extreme ends of the air-fuel range and in response thereto the system is changed from closed-loop to open-loop control mode in order to prevent the engine from operating under prolonged extreme mixture conditions.

In accordance with a first aspect of the invention, the variable reference is achieved by an averaging circuit responsive to a signal representative of the sensed concentration of the exhaust composition to provide an output of magnitude representative of a mean value of the magnitude of the sensed concentration. In order to prevent the reference level from being far outside of a controllable range when the system is under the open-loop control mode so that a valid signal is immediately generated upon resumption of closed-loop control, a range limiter is provided for the averaging circuit to allow the reference level to vary between upper and lower setting levels.

In accordance with a second aspect of the invention, the variable reference is accomplished by a peak detector connected to receive the signal representing the sensed concentration of the particular composition, and a voltage divider connected thereto. The peak detector detects a peak value of the input signal and hold the detected level in a capacitor, the output of which is divided by the voltage divider. A lower limit setting circuit is provided to prevent the reference level from becoming smaller than the predetermined lower setting level.

BRIEF DESCRIPTION OF THE DRAWINGS

These and other objects, advantages and features of the invention will become understood from the following description taken in conjunction with the accompanying drawings, in which.

DESCRIPTION OF THE PREFERRED EMBODIMENTS

Figure 1:
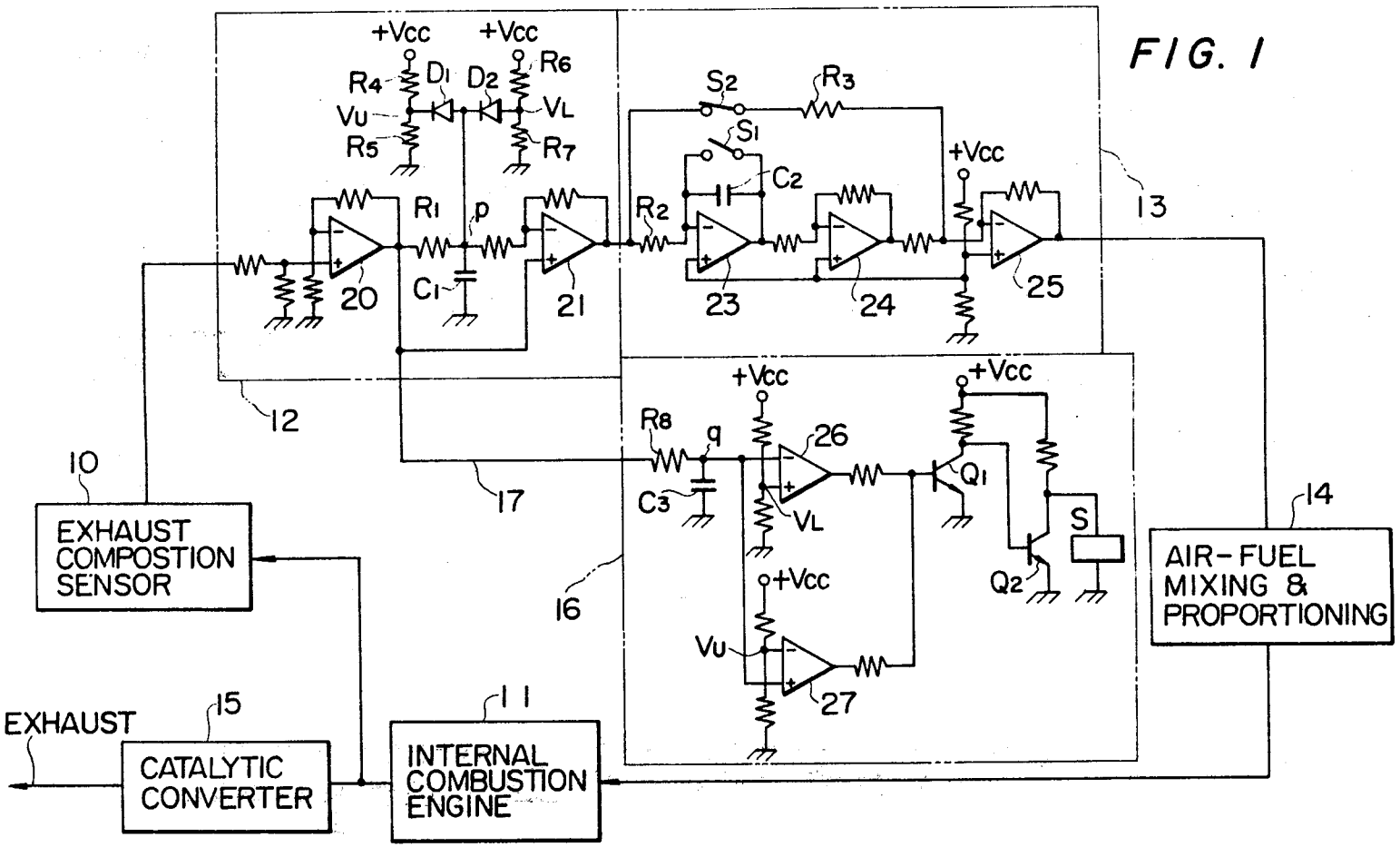
FIG. 1 is a diagrammatic representation of a first embodiment of the invention with related parts shown in functional block form.

An emission control apparatus of FIG. 1 for internal combustion engines comprises an exhaust composition sensor such as oxygen sensor 10 disposed in the passage of exhaust emissions from the internal combustion engine 11 to detect the concentration of residual oxygen in the emissions and provide an output having a characteristic change in amplitude at the stoichiometric point of the mixture combustion. Specifically, the output from the oxygen sensor 10 assumes high or low voltage levels depending upon whether the mixture is richer or leaner than stoichiometry, respectively. The sensor 10 output is modified through a circuit comprised by an error indication circuit 12 and a proportional-integral (PI) control unit 13 and fed back to an air-fuel mixing and proportioning device 14 of conventional design, the mixing and portioning device supplying air-fuel mixture as proportioned by the modified signal to the cylinders of the engine 11, thus completing a feedback controlled loop.

Considering FIG. 1 in greater detail, the error indicating or detector circuit 12 includes an DC buffer amplifier 20 formed by an operational amplifier which feeds an amplified concentration representative signal to the noninverting input of an operational amplifier 21 in a differential amplifier configuration and also to a disable control circuit 16 through lead 17. To the output of amplifier 20 is also connected an average circuit formed by a resistor R1 and a capacitor C1 coupled in series to ground which constitutes a reference input to the inverting input terminal of the differential amplifier 21. The time constant value of resistor R1 and capacitor C1 is selected such that the voltage across capacitor C1 represents a mean value of the sensed oxygen concentration. To a junction point "p" between the resistor R1 and capacitor C1 is connected a means for setting a range of upper and lower voltage levels within which the reference voltage is to be limited. A voltage divider formed by series-coupled resistors R4 and R5 sets the upper limit voltage $V_U$ at the junction therebetween which is in turn coupled to a diode D1 with polarity arranged such that its easy direction of conductivity allows current to be drawn from the junction point "p". Another voltage divider formed by series-coupled resistors R6 and R7 is provided to set the lower limit voltage $V_L$ at the junction therebetween which is in turn coupled to a diode D2 with polarity arranged such that its easy direction of conductivity allows current to be supplied from the junction between resistors R6 and R7 to the junction "p".

The upper limit voltage $V_U$ is, for example, selected at $\frac{3}{4}$ of the peak amplitude of the output of amplifier 20 and the lower limit voltage $V_L$ is at $\frac{1}{4}$ of the peak amplitude of the same output.

The output from the differential amplifier 21 thus represents the difference between the instantaneous value the sensed oxygen concentration and a mean value thereof which varies within a predetermined range. Since the output performance of the oxygen sensor 10 is represented by the peak value of its output, the mean valued voltage developed across the capacitor C1 changes with the changing peak value of the amplfier 20 so that the reference voltage on the average varies as the sensor 10 varies in performance with time. The effect of the range limit means is to clamp the voltage at the junction "p" at a constant value to prevent the reference voltage from becoming too high or too low, so that the voltage across capacitor C1 can be readily available as a reference level as soon as the system resumes its closed-loop operation after it has been operated to an open-loop mode as described below.

Referring to the proportional-integral controller 13, it will be seen that proportional control is provided by a single resistor R3 in series with a normally closed contact unit S2 coupled to the output of differential amplifier 21, while integral control is accomplished by an operational amplifier 23 having its inverting input coupled through an integrating resistor R2 to the output of differential amplifier 21 and also to the output thereof through an integrating capacitor C2. A normally open contact unit S1 is connected in parallel with the capacitor C2. The contact units S1 and S2 are both operated simultaneously by a relay to be described later to disable proportional and integral control functions simultaneously. The output from the integral controller 23 is polarity-inverted by an inverter 24 to correct the phase relation relative to the proportional control signal supplied through resistor R3 which meets at the inverting input of a summation amplifier 25 with the polarity inverted integrating control signal from amplifier 24. Both control signals add up in summation circuit 25 and applied to the air-fuel mixing and proportioning device 14.

The disable control circuit 16 includes an average circuit arranged to receive signal from the output of amplifier 20 of error detector 12, which circuit is formed by resistor R8 and capacitor C3 coupled in series to ground. The junction point "q" between resistor R8 and capacitor C3 is connected to the inverting input of a comparator 26 for comparison with a voltage substantially equal to the lower limit voltage $V_L$ and also to the non-inverting input of a comparator 27 for comparison with a voltage substantially equal to the upper limit voltage $V_U$. The comparators 26 and 27 constitute lower and upper level detectors, respectively, to trigger a transistor Q1 into conduction whenever the voltage at the junction point "q" reaches either of the upper and lower voltage levels $V_U$ and $V_L$. The turn-on of transistor Q1 turns off transistor Q2 to permit relay S to be energized. The relay S has its contacts S1 and S2 as previously described. When the average value of the sensed oxygen concentration reaches the upper or lower voltage level, the relay is operated to open the circuit of proportional controller while shorting the capacitor C2. Under these circumstances both control functions are disabled and the air-fuel mixing device 14 operates in an open loop control mode in which air-fuel mixing device 14 operates in a manner identical to that provided by conventional carburetion or fuel injection.

Because of the filtering action of resistor R8 and capacitor C3, the short duration pulsating voltage appearing at the output of amplitude 20 is absorbed or filtered out so that the detectors 26 and 27 are both triggered only when the output of amplifier 20 remains at one of high and low voltage levels over such a long period of time that the engine 10 is extremely enriched or leaned which is undesirable from the air pollution standpoint.

Since the operating performance of the oxygen sensor 10 varies with time such that its output peak voltage decreases from the rated value, the voltage developed at junction point "p" decreases slowly in proportion to the variation of the operating performance of the sensor 10. Therefore, the error detector 12 is thus provided with a function that self-compensates for the error arising from the deterioration of the sensor performance, and the output from the error detector 12 thus represents deviation of the sensed oxygen concentration from the error-compensated reference voltage.

During the time when the system is under open loop control mode as previously described, the voltage at point "p" is clamped at one of the higher and lower voltage levels $V_U$ and $V_L$ so that capacitor C1 is prevented from being overcharged or undercharged. Because of this clamping action, the voltage at the inverting input of differential amplifier 21 can be immediately used as a reference level as soon as the closed loop control is resumed when the average voltage at point "q" comes within the specified control range.

Figure 2:
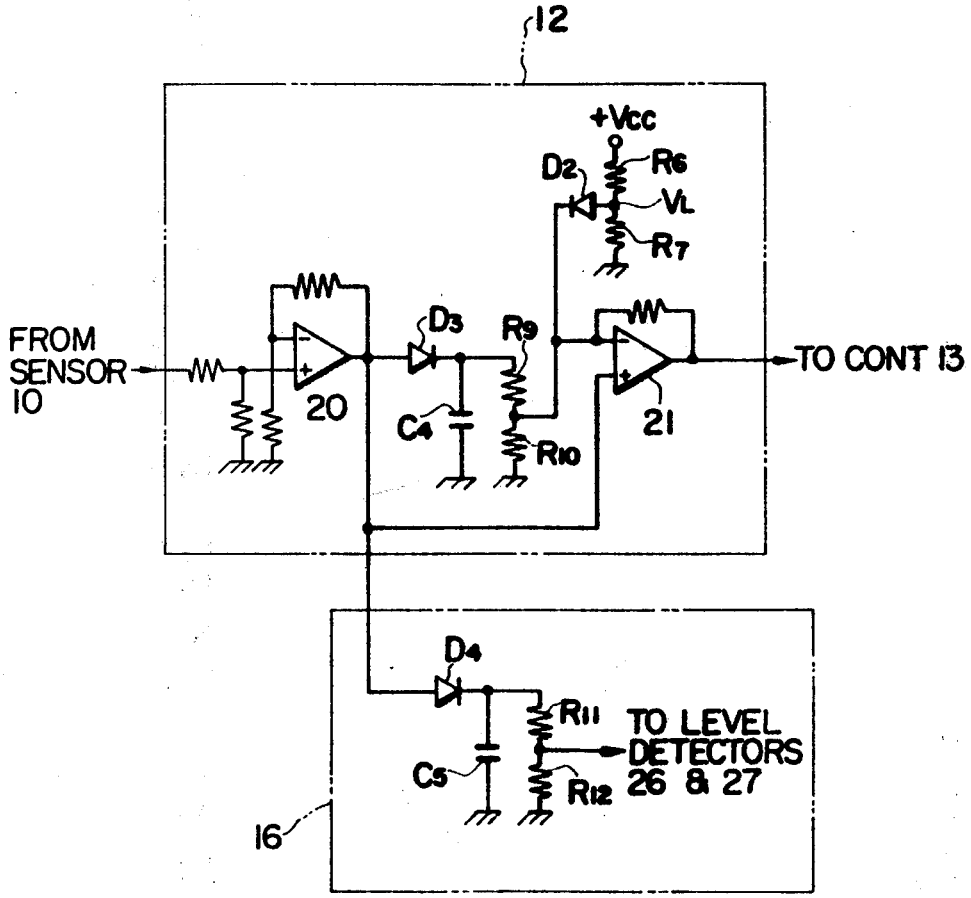
FIG. 2 is a modification of FIG. 1.

In FIG. 2, a modification of FIG. 1 is illustrated in which instead of connecting the output of DC amplifier 20 to the RC filter circuits R1, C1 and R8, C3, this output is connected to diodes D3 and D4 with polarity arranged such that their easy direction of conductivity allows current to charge capacitor C4 and C5 which are connected respectively to the diodes D3 and D4 and to ground.

The junction between diode D3 and capacitor C4 is connected to ground through a series-connected resistors R9 and R10, the junction of which is connected to the inverting input of differential amplifier 21 and also to the diode D2 of low-voltage level setting circuit. Similarly, the junction between diode D4 and capacitor C5 is in turn connected to ground through a series-connected resistors R11 and R12, the junction of which is connected to the inverting and noninverting inputs of level detectors 26 and 27, respectively.

With this arrangement, capacitors C4 and C5 are charged as long as the potential at the output of buffer amplifier 20 is higher than the voltage across capacitors C4 and C5, and the voltage across capacitors C4 and C5 remains substantially where it was after the potential at the output of amplifier 20 falls below the voltage across capacitors C4 and C5 so that capacitors C4 and C5 store the previous peak value of the output from amplifier 20. The resistors R9 and R10 have equal resistance value so that they develop a voltage of magnitude ½ of the voltage across capacitor C4 at their junction point as a reference input to the inverting input. Likewise, resistors R11 and R12 have equal resistance value to provide a voltage ½ of the voltage across capacitor C5 to the inputs to the level detectors 26 and 27. This circuit configuration allows the elimination of upper limit voltage setting circuit as in FIG. 1 because the reference voltage represents ½ of the peak value of the amplifier 20 output.

Figure 3:
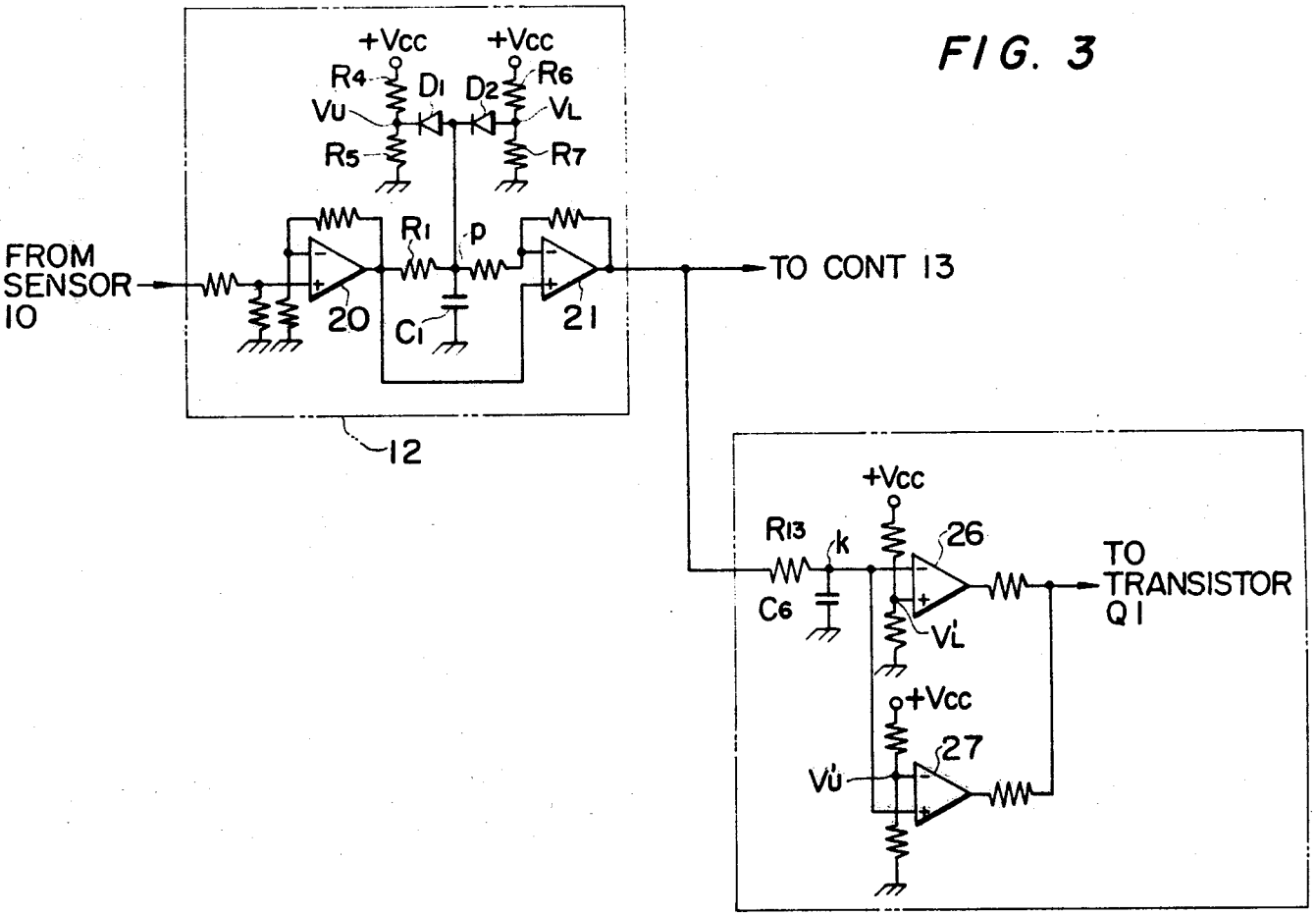
FIG. 3 is a further modification of FIG. 1.

A further modification of FIG. 1 is illustrated in FIG. 3 in which, instead of connecting the output of amplifier 20 to the disable control circuit 16, the output of differential amplifier 21 is connected to the disable control circuit 16. The junction point "k" between resistor R13 and capacitor C6 is fed to the level detectors 26 and 27 for comparison with a lower setting level $V_L'$ and an upper setting level $V_U'$. In this modification, therefore, the error indicating signal from the differential amplifier 21 is averaged by the RC filter circuit R13, C6.

In operation, the presence of rich mixture over a substantial period of time generates a high-level output from the amplifier 20 and the point "p" is substantially at the potential of upper setting level $V_U$ so that the deviation or error indicating signal from the differential amplifier 21 at a high voltage level causing the point "k" to rise to a high voltage level. If the potential at point "k" reaches the reference voltage $V_U'$, the level detector 27 will be triggered into the output-high state which eventually disables the closed loop control as described previously. Conversely, the presence of lean mixture over a substantial length of time will lower the potential at point "p" to the lower setting level $V_L$ and the output of the differential amplifier 21 remains low. The voltage at point "q" thus lowers and upon reaching the lower threshold level $V_L'$, the detector 26 will be switched into the output-high state to disable the closed loop control.

Figure 4:
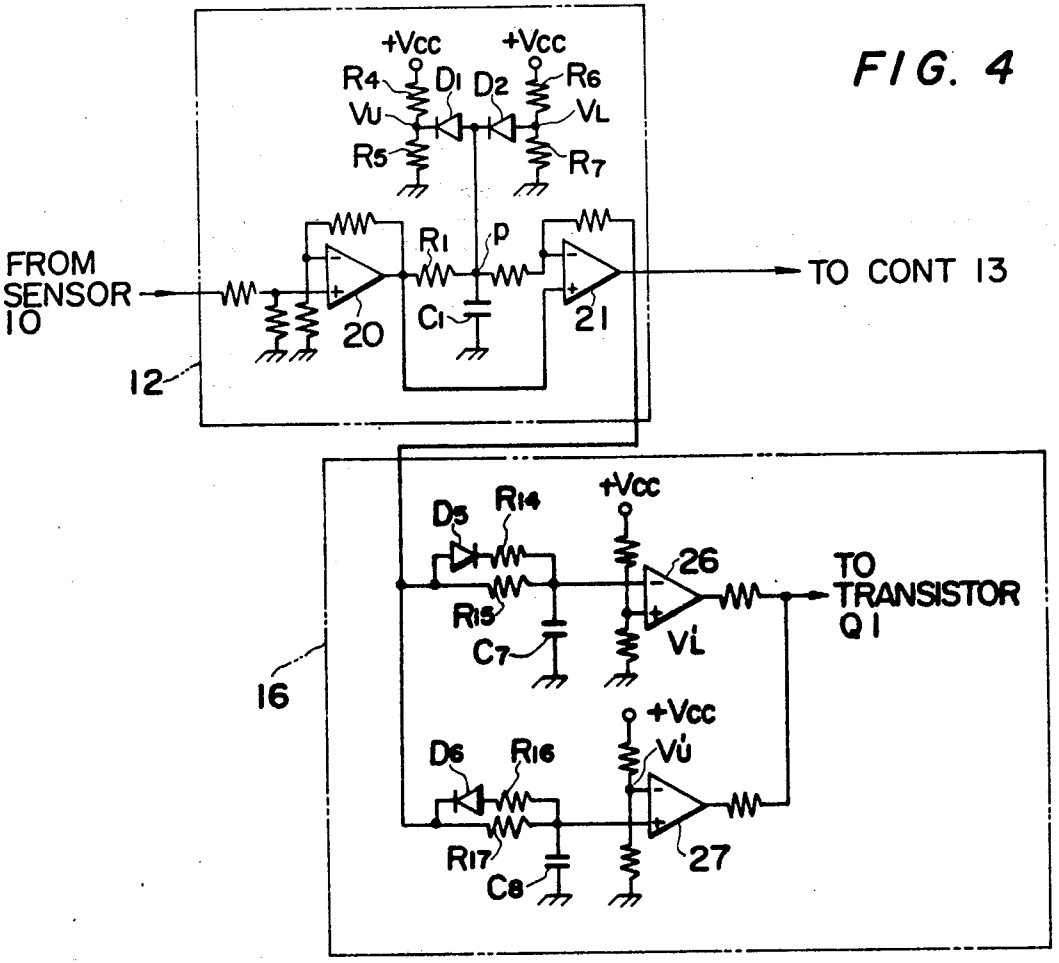
FIG. 4 is a modification of FIG. 3.

A modification of FIG. 3 is illustrated in FIG. 4 in which the average circuit R13, C6 is replaced with two averaging circuits: one is comprised of two parallel resistor circuits containing respectively a diode D5 and a resistor R14 in series, and a resistor R15. A capacitor C7 is coupled between the inverting input of operational amplifier 26 and ground. Resistor R15 has a resistance value equal to or greater than resistor R14, and the diode D5 is poled to allow current to quickly charge the capacitor C7, while the current that discharges the capacitor C7 flows through resistor R15 at a lower rate. The other averaging circuit is comprised of two parallel circuits containing respectively a diode D6 and a resistor R16 in series, and a resistor R17. A capacitor C8 is connected between the noninverting input of operational amplifier 27 and ground. Resistor R17 has an equal to or greater resistance value than resistor R16, and the diode D6 is so arranged to pass the current that discharges the capacitor C8 at a higher rate than it is charged through resistor R17.

If the oxygen sensor 10 is assumed to have been operating under low temperature conditions such as encountered in the engine start period, the error indicating signal from differential amplifier 21 remains at low voltage level and the closed loop control is disabled. When the engine has been warmed up so that the amplifier 20 output rises above the lower setting level $V_L$ and the error indicating signal from differential amplifier 21 rises to a high voltage level. Because of the smaller charging time constant value than the discharging time constant, capacitor C7 is charged instantaneously through the diode D5 and the resistor R14. Thus, the voltage across capacitor C7 jumps to a high voltage level to turn off transistor Q1 in response to the warm-up condition of the engine in order to operate it under closed loop control mode. It will be appreciated that in FIG. 4 the apparatus has a fast response time in resuming closed loop control as soon as the external conditions warrant.

On the other hand, the system is assumed to have been operating under open loop mode because of the prolonged rich mixture supply. Under these circumstances, the differential amplifier 21 delivers a high voltage output that charges capacitor C8 to provide a high level output from detector 27.

When the rich mixture condition terminates so that the differential amplifier 21 output falls below the upper setting level $V_U'$ the capacitor C8 will be instantaneously discharged through the resistors R16, R17 and the diode D6 with the result that the upper detector 27 is instantaneously switched off to resume closed loop control operation. Therefore, fast response characteristic is also provided for changing the system mode from open to close loop control when the prolonged rich mixture condition has terminated.

What is claimed is:

1. An emission control apparatus for an internal combustion engine having means for supplying air and fuel thereto in a variable ratio and an exhaust gas sensor for generating an exhaust gas sensor signal representative of the concentration of an exhaust gas composition of the emissions from said engine, said exhaust gas sensor signal having a range of values varying between a high signal strength value and a low signal strength value depending on the sensed exhaust gas concentration, comprising:

mean-value detecting means for generating a mean-valued signal representative of a mean value of said exhaust gas sensor signal and normally having a range of values narrower than the range of values of said exhaust gas sensor signal so long as said exhaust gas sensor signal is varying continuously;

differential amplifier means connected to receive said exhaust gas sensor signal and said mean-value signal for generating a differential amplifier signal representative of the deviation of said exhaust gas sensor signal from said mean value;

integral controller means receptive of said differential amplifier signal to integrate said deviation at a predetermined integration rate to generate a correction signal for application to said air-fuel supplying means;

level-detecting means for generating a range limit signal when said mean-value signal is outside of its normal range of values when said exhaust gas sensor signal remains at one of said high and low signal strength values for an extended period of time; and means for disabling said integral controller means in response to said range limit signal.

2. An emission control apparatus as claimed in claim 1, wherein said mean-value detecting means comprises an RC filter circuit connected between said exhaust composition sensor and said differential amplifier means to generate an output substantially representative of a mean value of the magnitude of the sensed concentration of the exhaust composition.

3. An emission control apparatus as claimed in claim 2, wherein said mean-value detecting means further comprises means for limiting the voltage across said capacitor within a predetermined range.

4. An emission control apparatus as claimed in claim 2, further comprising a second RC filter circuit connected between the output of said differential amplifier means and said level-detecting means to provide an output substantially representative of a mean value of the magnitude of the output from said differential amplifier means.

5. An emission control apparatus as claimed in claim 1, wherein said level-detecting means comprises a first comparator for comparing said output from said second RC filter circuit with a first reference value to determine whether said output is below said reference value, and a second comparator for comparing said output from said second RC filter circuit with a second reference value to determine whether said output is above said second reference value.

6. An emission control apparatus as claimed in claim 5, further comprising a second and a third RC filter circuit, the second RC filter circuit comprising a first capacitor, a first resistor and a diode all of which are connected in series to the output of said differential amplifier means with a polarity arranged such that its easy direction of conductivity is to charge said first capacitor through said first resistor, and a second resistor connected in parallel with said first resistor and said first diode to allow said first capacitor to discharge therethrough at a rate lower than the rate at which said capacitor is charged, said third RC filter circuit comprising a second capacitor, a third resistor and a second diode all of which are connected in series to the output of said differential amplifier means with a polarity arranged such that its easy direction of conductivity is to discharge said second capacitor through said third resistor, and a fourth resistor connected in parallel with said third resistor and said second diode to charge said second capacitor at a rate lower than the rate at which said second capacitor is discharged, the voltages developed in said first and second capacitors being coupled to said first and second comparators for comparison with said first and second reference values, respectively.

7. An emission control apparatus as claimed in claim 1, wherein said mean-value detecting means comprises means for detecting a peak value of the sensed concentration of the exhaust composition and holding the detected peak value and a voltage divider connected between said peak detecting and holding means and said differential amplifier.

8. An emission control apparatus as claimed in claim 7, wherein said peak detecting and holding means comprises a capacitor and a diode connected to said exhaust composition sensor with a polarity arranged such that its easy direction of conductivity is to allow the output from said exhaust composition sensor to charge said capacitor, said voltage divider being connected across said capacitor.

9. An emission control apparatus as claimed in claim 7, further comprising means for preventing the magnitude of the output of said voltage divider from becoming smaller than a predetermined threshold level.

10. An emission control apparatus as claimed in claim 7, further comprising second means for detecting a peak value of the sensed concentration of the exhaust composition and holding the detected peak value, and a second voltage divider connected between said second peak detecting and holding means and said level-detecting means.

11. An emission control apparatus for an internal combustion engine having air-fuel mixing and proportioning means, comprising:

an exhaust composition sensor for generating a first signal representative of the concentration of an exhaust composition of the emissions from said engine;

means for generating a second signal substantially representing a mean value of the first signal;

a differential amplifier having a first input responsive to the first signal and a second input responsive to the second signal for generating a third signal representative of the difference between the first and second signals;

means connected to the output of said differential amplifier for modifying the magnitude of said third signal in accordance with a predetermined control characteristic for application to said air-fuel mixing and proportioning means;

means for detecting when the sensed concentration of said exhaust composition reaches a predetermined threshold level; and means for disabling said magnitude modifying means when said threshold level is reached, wherein said second signal generating means comprises an RC filter circuit connected between said exhaust composition sensor and said second input of said differential amplifier to generate an output substantially representative of a mean value of the magnitude of the sensed concentration of the exhaust composition, wherein said second signal generating means further comprises means for limiting the voltage across said capacitor within a predetermined range, and wherein said limiting means comprises a first diode connecting said capacitor to a first source of voltage selected to serve as an upper limit, the polarity of said diode being arranged such that the easy direction of conductivity thereof is to discharge said capacitor when the voltage thereacross exceeds said upper limit, and a second diode connecting said capacitor to a second source of voltage selected to serve as a lower limit, the polarity of said second diode being arranged such that the easy direction of conductivity thereof is to charge said capacitor when the voltage thereacross falls below said lower limit.

12. Emission control apparatus as claimed in claim 11, further comprising a DC buffer amplifier connected between said exhaust composition sensor and said RC filter circuit.

13. Emission control apparatus as claimed in claim 12, further comprising a second RC filter circuit connected to receive a signal representative of the sensed concentration of the exhaust composition to provide to said detecting means an output substantially representative of a mean value of the magnitude of the input signal thereto.

14. Emission control apparatus as claimed in claim 13, wherein said detecting means comprises a first comparator for comparing said output from said second RC filter circuit with a first reference value to determine whether said output is below said reference value, and a second comparator for comparing said output from said second RC filter circuit with a second reference value to determine whether said output is above said second reference value.

15. An emission control apparatus for an internal combustion engine having air-fuel mixing and proportioning means, comprising:

an exhaust composition sensor for generating a first signal representative of the concentration of an exhaust composition of the emissions from said engine;

means for generating a second signal substantially representing a mean value of the first signal;

a differential amplifier having a first input responsive to the first signal and a second input responsive to the second signal for generating a third signal representative of the difference between the first and second signals;

means connected to the output of said differential amplifier for modifying the magnitude of said third signal in accordance with a predetermined control characteristic for application to said air-fuel mixing and proportioning means;

means for detecting when the sensed concentration of said exhaust composition reaches a predetermined threshold level; and means for disabling said magnitude modifying means when said threshold level is reached; and wherein said second signal generating means comprises means for detecting a peak value of the sensed concentration of the exhaust composition and holding the detected peak value and a voltage divider connected between said peak detecting and holding means and said second input of said differential amplifier.

16. Emission control apparatus as claimed in claim 15, wherein said peak detecting and holding means comprises a capacitor and a diode connected to said exhaust composition sensor with polarity arranged such that its easy direction of conductivity is to allow the output from said exhaust composition sensor to charge said capacitor, said voltage divider being connected across said capacitor.

17. Emission control apparatus as claimed in claim 15, further comprising means for preventing the magnitude of the input signal to said second input of said differential amplifier from becoming smaller than a predetermined threshold level.

18. Emission control apparatus as claimed in claim 15, further comprising second means for detecting a peak value of the sensed concentration of the exhaust composition and holding the detected peak value, and a second voltage divider connected between said second peak detecting and holding means and said means for detecting when the sensed concentration of the exhaust composition reaches a predetermined threshold level.

19. Emission control apparatus as claimed in claim 15, further comprising an RC filter circuit connected between the output of said differential amplifier and said detecting means to provide an output substantially representative of a mean value of the magnitude of the output from said differential amplifier.

20. An emission control apparatus for an internal combustion engine having air-fuel mixing and proportioning means, comprising:

an exhaust composition sensor for generating a first signal representative of the concentration of an exhaust composition of the emissions from said engine;

means for generating a second signal substantially representing a mean value of the first signal;

a differential amplifier having a first input responsive to the first signal and a second input responsive to the second signal for generating a third signal representative of the difference between the first and second signals;

means connected to the output of said differential amplifier for modifying the magnitude of said third signal in accordance with a predetermined control characteristic for application to said air-fuel mixing and proportioning means;

means for detecting when the sensed concentration of said exhaust composition reaches a predetermined threshold level; and means for disabling said magnitude modifying means when said threshold level is reached;

wherein said second signal generating means comprises an RC filter circuit connected between said exhaust composition sensor and said second input of said differential amplifier to generate an output substantially representative of a mean value of the magnitude of the sensed concentration of the exhaust composition;

further comprising a second RC filter circuit connected between the output of said differential amplifier and said detecting means to provide an output substantially representative of a mean value of the magnitude of the output from said differential amplifier; and wherein said detecting means comprises a first comparator for comparing said output from said second RC filter circuit with a first reference value to determine whether said output is below said reference value, and a second comparator for comparing said output from said second RC filter circuit with a second reference value to determine whether said output is above said second reference value.

21. An emission control apparatus for an internal combustion engine having air-fuel mixing and proportioning means, comprising:

an exhaust composition sensor for generating a first signal representative of the concentration of an exhaust composition of the emissions from said engine;

means for generating a second signal substantially representing a mean value of the first signal;

a differential amplifier having a first input responsive to the first signal and a second input responsive to the second signal for generating a third signal representative of the difference between the first and second signals;

means connected to the output of said differential amplifier for modifying the magnitude of said third signal in accordance with a predetermined control characteristic for application to said air-fuel mixing and proportioning means;

means for detecting when the sensed concentration of said exhaust composition reaches a predetermined threshold level; and means for disabling said magnitude modifying means when said threshold level is reached, wherein said second signal generating means comprises an RC filter circuit connected between said exhaust composition sensor and said second input of said differential amplifier to generate an output substantially representative of a mean value of the magnitude of the sensed concentration of the exhaust composition; and further comprising a second and a third RC filter circuit, the second RC filter circuit comprising a first capacitor, a first resistor and a diode connected in series to the output of said differential amplifier with polarity arranged such that its easy direction of conductivity is to charge said first capacitor through said first resistor, and a second resistor connected in parallel with said first resistor and said first diode in series to allow said first capacitor to discharge therethrough at a rate lower than the rate at which said capacitor is charged, said third RC filter circuit comprising a second capacitor, a third resistor and a second diode connected in series to the output of said differential amplifier with polarity arranged such that its easy direction of conductivity is to discharge said second capacitor through said third resistor, and a fourth resistor connected in parallel with said third resistor and said second diode to charge said second capacitor at a rate lower than the rate at which said second capacitor is discharged.

* * * * *